US006488281B2

(12) United States Patent
Stupak

(10) Patent No.: US 6,488,281 B2
(45) Date of Patent: Dec. 3, 2002

(54) MINIMUM LOSS, MAXIMUM WIN WAGERING SYSTEM

(76) Inventor: Bob Stupak, 1301 S. Sixth St., Las Vegas, NV (US) 89101

( * ) Notice: Subject to any disclaimer, the term of this patent is extended or adjusted under 35 U.S.C. 154(b) by 0 days.

(21) Appl. No.: 09/733,538

(22) Filed: Dec. 7, 2000

(65) Prior Publication Data

US 2002/0113367 A1 Aug. 22, 2002

Related U.S. Application Data

(60) Provisional application No. 60/169,544, filed on Dec. 7, 1999.

(51) Int. Cl.[7] ..... A63B 71/00
(52) U.S. Cl. ..... 273/138.1; 273/236; 273/274
(58) Field of Search ..... 273/138.1, 274, 273/236; 463/13, 16, 28

(56) References Cited

U.S. PATENT DOCUMENTS 4,322,612 A * 3/1982 Lange ..... 235/419
4,882,473 A * 11/1989 Bergeron et al. ..... 235/380
5,276,312 A * 1/1994 McCarthy ..... 235/380
5,401,023 A * 3/1995 Wood ..... 273/85 CP
5,511,781 A * 4/1996 Wood et al. ..... 273/85 CP
5,687,968 A * 11/1997 Tarantino ..... 273/139
5,743,525 A * 4/1998 Haddad ..... 273/139
5,772,509 A * 6/1998 Weiss ..... 463/16
5,816,919 A * 10/1998 Scagnelli et al. ..... 463/25
5,830,068 A * 11/1998 Brenner et al. ..... 463/42
5,888,136 A * 3/1999 Herbert ..... 463/22
5,921,865 A * 7/1999 Scagnelli et al. ..... 463/17
5,938,200 A * 8/1999 Markowicz et al. ..... 273/246
5,951,297 A * 9/1999 Schwartz ..... 463/167
5,954,582 A * 9/1999 Zach ..... 463/25
6,004,211 A * 12/1999 Brenner et al. ..... 463/40
6,032,955 A * 3/2000 Luciano et al. ..... 273/138.1
6,089,981 A * 7/2000 Brenner et al. ..... 463/20
6,099,409 A * 8/2000 Brenner et al. ..... 463/40
6,131,908 A * 10/2000 Palmer ..... 273/292
6,152,822 A * 11/2000 Herbert ..... 463/22
6,155,925 A * 12/2000 Giobbi et al. ..... 463/20
6,186,502 B1 * 2/2001 Perkins ..... 273/138.1
6,236,900 B1 * 5/2001 Geiger ..... 700/91
6,254,480 B1 * 7/2001 Zach ..... 463/17
6,270,405 B1 * 8/2001 Ferguson ..... 463/13
6,309,307 B1 * 10/2001 Krause et al. ..... 473/274
6,325,375 B1 * 12/2001 Potter et al. ..... 273/292

* cited by examiner

*Primary Examiner*—Benjamin H. Layno
*Assistant Examiner*—Dolores R. Collins
(74) *Attorney, Agent, or Firm*—Philip J. Anderson; Anderson & Morishita, LLC

(57) ABSTRACT

A method is set forth which minimizes a player's loss when wagering on the outcomes of a set of games. The player makes an initial wager for N outcomes of N(X+Y) where X is the wager for the outcome and Y is the casino's vigorish. If the player has greater than one-half of winning outcomes W of the set, they are paid W(X+Y+X). Where half or less than half of the set N are winning outcomes, the player is paid one half of the original wager.

6 Claims, No Drawings

MINIMUM LOSS, MAXIMUM WIN WAGERING SYSTEM

RELATED APPLICATION DATA

The present application claims priority to U.S. Provisional Application Ser. No. 60/169,544 entitled "Minimum Loss, Maximum Win Wagering System" filed Dec. 7, 1999 by applicant herein.

FIELD OF THE INVENTION

The present invention is directed to a method for providing a wagering game wherein the player has a fixed liability for a maximum loss.

BACKGROUND OF THE INVENTION

Sports wagering typically involves a player selecting a sports proposition, e.g. which team will win a contest, and making a desired wager on the contest. This is a single proposition wager. It is also known to provide what are known as parlay wagers based upon a plurality of propositions. For example, a player could bet a football parlay involving ten games. The player would make a required wager and would select, for each of the ten football games, a winner. If all (ten out of ten) or substantially all (e.g. eight out of ten or better) of the player's picks are winners, the player wins and is paid based upon the wager. If fewer than a predetermined number of picks are winners the player losses the wager.

It is also known that a player can select, for example, ten contests and make a separate wager on each, for example $100. In most cases, for each contest predetermined payoffs are provided based upon established odds if the player has selected the winner, e.g. 9 to 5. Each contest is either won or lost and the player is paid or loses his wager independent of the other contests.

A drawback to this type of wagering is that the player may lose all of his wagers and therefore is less likely to make large wagers for each contest. That is, if the player had a predetermined maximum amount that the player could lose which is less than all of the amount wagered, the player may be induced to wager greater amounts. For example, if a player would normally wager $10 on each of ten games, the player has at risk $100 if the player fails to pick any winners. However, if the player was assured that the player would only lose a maximum of half the wagers, the player may be induced to wager 25$ per game knowing that the player could only lose a maximum of $125 for the ten games even should the player fail to pick any winners in a ten game selection.

There is, therefore, a need in the art to provide a contest or gaming method wherein the player has only at risk a predetermined amount which is less than the total amount wagered. There is a need for such a method in sports proposition wagering and table games such as Roulette and the like where substantially even money payouts are provided.

SUMMARY OF THE INVENTION

There is, therefore, set forth according to the present invention a method which provides for a player to wager on a set of N outcomes, such as sporting events like football games, each having a winning and a losing outcome, and which limits the player's exposure to loss.

The method according to the present invention is for playing a wagering game on a predetermined set of N event outcomes (e.g. N football games), each event having an outcome of a win or a loss. The method includes the player wagering an amount X+Y for each event outcome of the set N, where Y designates the profit or vigourish for the casino. Thus to play, the player makes a total wager of N(X+Y). The outcomes are thereafter determined. For the number of winning outcomes W obtained of the set the player is paid an award of W((X+(X+!)) and for each losing outcome the players wager for that outcome is lost subject to the minimum loss aspect of the method. Where for any set the player has less than or equal to one-half losing outcomes, i.e where N is ten games and the player has 5 or less winning outcomes, the player is paid one half of his original wager (N(X+Y)/2). Thus the player's maximum loss is one half of their original wager.

DESCRIPTION

In one embodiment of the present invention, the method is directed to sports wagering and similarly directed proposition wagering which includes a plurality of propositions. As but an example, wagering on football games will be described; however it should be understood that the method could be directed to other sports such as baseball, hockey, basketball, soccer or the like where, for a given time frame, a plurality of propositions such as who will win a games is presented. Further, for purposes of this example, it will be assumed that the game according to the method embraces ten football games; however it should be understood that any number of a plurality of games could be selected.

The method includes a player making a wager of a predetermined amount such as, for example, any multiple of ten, to participate in the game. For purposes of this description it will be assumed that each player wagers $1100 to bet $100 per game of the ten game set. The wagering of 11 to win 10 provides the casino with a profit. The player when making the wager provides his selections as to which team will win each game. The selection and wagering is made on the basis that each winning wager will pay even money , e.g. $100. That is, if the player selects a winner for a game, they would, subject to the qualifications below, be paid a profit of $100 for a total payback of $210 representing their wager of $110 plus their win of $100.

Further, the player understands that the maximum amount they can lose on their wager is a predetermined amount less than the total amount wagered such as, in the present example, $550 representing half of their wager. Thus, for the player making a $1100 wager, they know the worst they can do is have returned to them $550. As an alternative embodiment, the player may pay only $550 to, in effect, wager $110 on ten games. If the player loses completely, they would only lose that $550.

For the game, the following pay schedule may be adopted; however it is to be understood that other schedules could be used. The player has made an initial wager of $550 to, in effect, play 10 games with an effective wager of $110 per game.

| No. of Winning Picks | Payback to Player |
|---|---|
| 0 | $0 |
| 1 | $0 |
| 2 | $0 |
| 3 | $0 |
| 4 | $0 |

-continued

| No. of Winning Picks | Payback to Player |
|---|---|
| 5 | $0 |
| 6 | $660 + $600 = $1260 |
| 7 | $770 + $700 = $1470 |
| 8 | $880 + $800 = $1680 |
| 9 | $990 + $900 = $1890 |
| 10 | $1100 + $1000 = $2100 |

The profit to the casino for hosting the game is the 11 to 10 lay as well as the fact that for 0–5 wins, the casino is making a profit of $550 and the chances that in a field of players and a distribution of outcomes, a number of players will have 0–5 wins will cover the payouts by the casino for players who receive a payback.

Alternatively the player can be required to post an up front wager of $1100 for the ten games resulting in a payback schedule of:

| No. of Winning Picks | Payback to Player |
|---|---|
| 0 | $550 |
| 1 | $550 |
| 2 | $550 |
| 3 | $550 |
| 4 | $550 |
| 5 | $550 |
| 6 | $660 + $600 = $1260 |
| 7 | $770 + $700 = $1470 |
| 8 | $880 + $800 = $1680 |
| 9 | $990 + $900 = $1890 |
| 10 | $1100 + $1000 = $2100 |

Thus the player is assured of receiving back a minimum amount inducing the player to wager greater amounts.

The method includes, therefore, providing a game having a plurality of separate propositions each providing an even money payoff, selecting an amount to be wagered upon each game of the set, setting the maximum amount which the player can lose which is less than the total amount wagered and designating from 0 to a predetermined number of player winning outcomes as maximum loss payoffs and providing payoffs for the remainder. By designating certain numbers of outcomes as maximum loss paybacks which ordinarily would have received a greater payback, the casino is provided with the opportunity to make a profit. For example for 5 wins the player would normally receive $550+$500, or 1050 and they now receive only $550. In other embodiments of the game, the method can be employed in table games where even money payoffs are provided such as for a predetermined number of Roulette wagers.

While certain embodiments of the present invention have been shown and described it is to be understood that the present invention is subject to many modifications and changes without departing from the spirit and scope of the claims presented herein.

I claim:

1. A method for playing a wagering game on a predetermined set of N event outcomes, each event having an independent outcome of a win or a loss, the method comprising:

the player selecting an outcome for each event of the set N;

the player wagering an amount X+Y for each event outcome of the set N, Y designated as a profit for a wager of X, for a total wager of N(X+Y);

issuing an award to the player for his set wager according to the following, (a) if the player has $\leqq N/2$ winning selections W paying the player N(X+Y)/2 or (b) if the player has >N/2 winning selections W paying the player an award of W((X+(X+Y)).

2. The method of claim 1 comprising setting Y at 10% of X.

3. The method of claim 1 comprising the player selecting a winner for each event of the set N.

4. A method for playing a wagering game on a predetermined set of N event outcomes, each event having an independent outcome of a win or a loss, the method comprising:

the player selecting an outcome for each event of the set;

the player wagering an amount equal to ½ N(X+Y) for each outcome of the set N, Y designated as a profit for a wager of X;

issuing an award to the player for his set wager according to the following, (a) if the player has $\leqq N/2$ winning selections W, the player losing and receiving no award or (b) if the player has >N/2 winning selections W paying the player an award of W((X+(X+Y)).

5. The method of claim 4 comprising setting Y at 10% of X.

6. The method of claim 4 comprising the player selecting a winner for each event of the set N.

* * * * *